US008960514B2

(12) United States Patent
Lee

(10) Patent No.: US 8,960,514 B2
(45) Date of Patent: Feb. 24, 2015

(54) DISPENSER

(76) Inventor: Yong-jun Lee, Gunpo-si (KR)

( * ) Notice: Subject to any disclaimer, the term of this patent is extended or adjusted under 35 U.S.C. 154(b) by 372 days.

(21) Appl. No.: 13/389,785

(22) PCT Filed: Jul. 20, 2010

(86) PCT No.: PCT/KR2010/004721

§ 371 (c)(1),
(2), (4) Date: Feb. 9, 2012

(87) PCT Pub. No.: WO2011/021781

PCT Pub. Date: Feb. 24, 2011

(65) Prior Publication Data

US 2012/0138654 A1 Jun. 7, 2012

(30) Foreign Application Priority Data

Aug. 21, 2009 (KR) ..... 20-2009-0010950 U
Sep. 3, 2009 (KR) ..... 10-2009-0082934
May 6, 2010 (KR) ..... 10-2010-0042370

(51) Int. Cl.
*B65H 35/10* (2006.01)
*A47K 10/38* (2006.01)

(52) U.S. Cl.
CPC ..... *A47K 10/3827* (2013.01); *A47K 2010/3881* (2013.01)
USPC ..... 225/39

(58) Field of Classification Search
CPC ..... A47K 10/3827; A47K 2010/3881; A47K 10/36; A47K 10/32; A47K 2010/328; H03K 2017/9606; B65H 35/10; B65H 35/00; B65H 45/00; B65H 2513/52; B65H 35/0006; G07C 3/08; G02F 1/133528; G02F 2001/133538; G02F 2001/133374
USPC ..... 225/39, 2, 93, 3, 10, 14, 72, 82, 12, 15; 83/649, 370, 367; 242/564.1, 560; 349/64, 56, 65; 221/135
See application file for complete search history.

(56) References Cited

U.S. PATENT DOCUMENTS

| | | | | |
|---|---|---|---|---|
| 6,098,917 | A | 8/2000 | Cruz | |
| 7,101,441 | B2 * | 9/2006 | Kennard | 118/672 |
| 2004/0090578 | A1 * | 5/2004 | Chang et al. | 349/117 |
| 2005/0167541 | A1 * | 8/2005 | Osborne | 242/563 |
| 2007/0272701 | A1 * | 11/2007 | Carlsson et al. | 221/135 |
| 2014/0067113 | A1 * | 3/2014 | Petersen et al. | 700/236 |

FOREIGN PATENT DOCUMENTS

| | | | | |
|---|---|---|---|---|
| JP | 06269374 A | | 9/1994 | |
| JP | 2005245647 A | * | 9/2005 | A47K 10/36 |

(Continued)

*Primary Examiner* — Ghassem Alie
(74) *Attorney, Agent, or Firm* — Schmeiser, Olsen & Watts LLP

(57) ABSTRACT

The present invention relates to a dispenser for supplying a disposable paper product of a roll type such as a toilet paper, a hand towel and etc. The dispenser has a main body casing which accommodates the paper product and has a rotating shaft supporting the paper product to be rotatable and a discharging part for discharging the paper product, and a wet type cutting unit which is located at the discharging part to provide liquid to a part of the paper product that is to be cut. Liquid is provided to an area of the paper product to be cut, so that the paper product can be easily cut with a relatively small force.

4 Claims, 18 Drawing Sheets

(56) References Cited

FOREIGN PATENT DOCUMENTS

| | | | | |
|---|---|---|---|---|
| JP | 3149818 | 4/2009 | | |
| KR | 2019900000262 | U | 1/1990 | |
| KR | 1020040058260 | A | 7/2004 | |
| KR | 1020060037672 | A | 5/2006 | |
| KR | 1020090002396 | A | 1/2009 | |

* cited by examiner

DISPENSER

TECHNICAL FIELD

The present invention relates to a dispenser for supplying a disposable paper product of a roll type such as a toilet paper, a hand towel and etc. and more particularly to a dispenser having an enhanced structure to enable the paper product to be easily cut with a relatively small force.

BACKGROUND ART

In general, a dispenser is widely used which supplies a disposable paper product of a roll type such as a toilet paper, a hand towel and etc.

FIG. 1 is a front sectional view of a conventional dispenser. As shown in FIG. 1, the conventional dispenser 1 has a rotating shaft 13 which is inserted into a through hole 3*a* of a toilet paper 3 to support it to be rotatable and a discharging part 15 through which the toilet paper 3 is discharged. The dispenser 1 has a main body casing 10 which accommodates the toilet paper 3 therein.

Also, a cutting edge 14 is formed at the discharging part 15 of the main body casing 10 to cut the toilet paper 3.

However, according to such a conventional dispenser 1, when a user intends to cut the toilet paper 3, it usually slides on the cutting edge 14 to make it inconvenient for the user to cut the toilet paper 3.

DISCLOSURE

Technical Problem

Accordingly, an object of the present invention is to provide a dispenser which provides liquid onto an area of a paper product to be cut so that the paper product can be easily cut with a relatively small force.

Technical Solution

In order to accomplish the above object, the present invention provides a dispenser for supplying a disposable paper product of a roll type comprising: a main body casing which accommodates the paper product and has a rotating shaft supporting the paper product to be rotatable and a discharging part for discharging the paper product, and a wet type cutting unit which is located at the discharging part to provide liquid to a part of the paper product that is to be cut.

According to an aspect of the present invention, the wet type cutting unit comprises a cutting casing which has a liquid discharging part at a part thereof and a sponge receiving space therein and a pair of guiding parts which extend from the liquid discharging part to have a shape of plates with a predetermined gap there between.

According to an aspect of the present invention, the wet type cutting unit further comprises a sponge unit having a first sponge which is received in the sponge receiving space of the cutting casing and a second sponge which extends from the first sponge and is received between a pair of the guiding parts.

According to an aspect of the present invention, at least one of the guiding parts has a free end area which is formed with a cutting edge having a shape of a saw or a blade.

According to an aspect of the present invention, the cutting casing is formed with a liquid inlet for supplying liquid from outside.

According to an aspect of the present invention, a dispenser for supplying a disposable paper product of a roll type is provided which comprises a main body casing which accommodates the paper product and has a rotating shaft supporting the paper product to be rotatable and a discharging part for discharging the paper product; an elastic discharging unit which has a wire rolled at a side of the main body casing and supplies the paper product by rotating the rotating shaft elastically when the wire is pulled by an outer force; and a wet type cutting unit which is located at the discharging part to provide liquid to a part of the paper product that is to be cut.

According to an aspect of the present invention, the elastic discharging unit comprises a driving shaft connected with the rotating shaft, an elastic member driving shaft provided apart from the driving shaft, the wire rolled at an end part of the elastic member driving shaft and pulled downward by the outer force, a windup spring wound around the elastic member driving shaft and driving the elastic member driving shaft to rotate if the wire is pulled downward so that the wire can return upward, and a gear train transferring a rotation force due to the windup spring from the elastic member driving shaft to the driving shaft.

According to an aspect of the present invention, the gear train comprises a first gear coupled to the elastic member driving shaft, a second gear coupled to the driving shaft and a third gear provided between the first gear and the second gear to transfer the rotation force.

According to an aspect of the present invention, the gear train further comprises a clutch gear which transfers the rotation force from the elastic member driving shaft to the driving shaft only while the wire is being pulled downward.

According to an aspect of the present invention, the main body casing further comprises a product receiving part which is provided near the discharging part to receive the paper product that is supplied due to a rotation of the driving shaft.

According to an aspect of the present invention, the main body casing further comprises a discharging guide which is provided at an inside from the discharging part to guide the paper product that is supplied due to a rotation of the driving shaft.

According to an aspect of the present invention, a dispenser for supplying a disposable paper product of a roll type is provided which comprises a main body casing which accommodates the paper product and has a rotating shaft supporting the paper product to be rotatable and a discharging part for discharging the paper product; an elastic discharging unit which has a wire rolled at a side of the main body casing and supplies the paper product by rotating the rotating shaft elastically when the wire is pulled by an outer force; a wet type cutting unit which is located at the discharging part to provide liquid to a part of the paper product that is to be cut; and a display unit comprising a display panel which is mounted to the main body casing to display letters, pictures or advertisements, a liquid crystal panel which is attached to the display panel to pass or reflect light, a polarization film which is attached to the liquid crystal panel and a power supplying part which supplies an electric power to the liquid crystal panel.

According to an aspect of the present invention, the main body casing further comprises a product receiving part which is provided near the discharging part to receive the paper product that is supplied due to a rotation of the driving shaft.

According to an aspect of the present invention, the power supplying part is a solar battery which converts a light energy emitted from a natural light or an illuminating device into an electric energy.

According to an aspect of the present invention, a dispenser for supplying a disposable paper product of a roll type is provided which comprises a main body casing which accommodates the paper product and has a rotating shaft supporting the paper product to be rotatable and a discharging part for discharging the paper product; an elastic discharging unit which has a wire rolled at a side of the main body casing and supplies the paper product by rotating the rotating shaft elastically when the wire is pulled by an outer force; a wet type cutting unit which is located at the discharging part to provide liquid to a part of the paper product that is to be cut; and a memo board comprising a transparent memo plate which is mounted to the main body casing, an illuminating part which is fixed to an end part of the transparent memo plate to emit light through the transparent memo plate, a power supplying part for supplying an electric power to the illuminating part and a power supplying switch for controlling an electric current applied from the power supplying part.

Advantageous Effects

According to the present invention as described above, a dispenser is provided which provides liquid onto an area of a paper product to be cut so that the paper product can be easily cut with a relatively small force.

Also, according to the present invention, the sponge unit can hold an aroma oil therein to provide a fragrance to a room or to the paper product, so that there is no need of additionally equipping with a perfume or an aromatic.

Also, according to the present invention, a user needs only to pull a wire to a length he or she wants then a rotating shaft is rotated by an elastic force from an elastic member and the paper product is supplied through a discharging part, so that a user's convenience can be enhanced.

Also, according to the present invention, a display unit is provided to a front surface of the dispenser for making the user recognize advertising words or design, so that an advertising effect can be heightened.

BEST MODE

Figure 1:
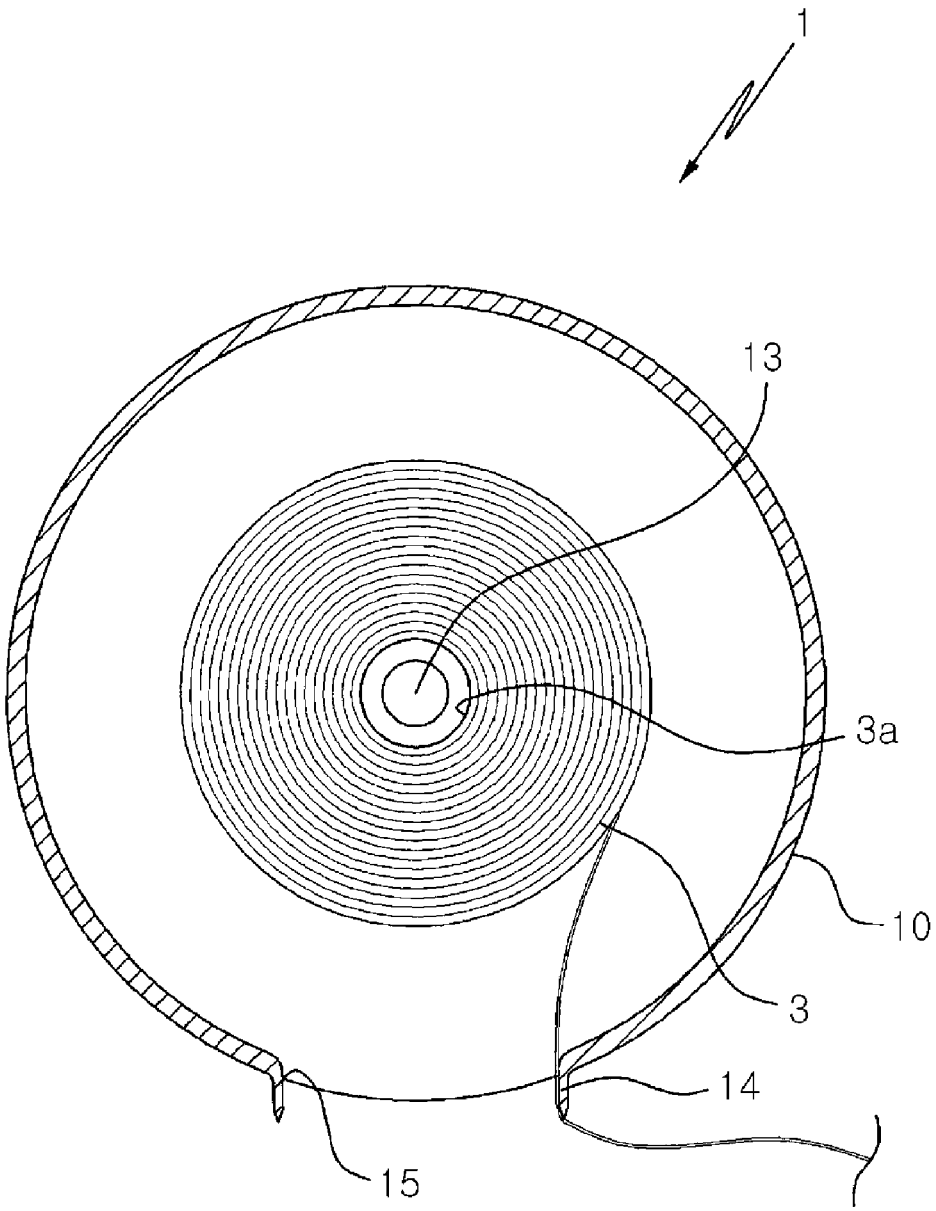
FIG. 1 is a front sectional view of a conventional dispenser.

To make the present invention fully understood, a few preferable embodiments of the present invention are described with reference to the drawings attached herewith.

The embodiments can be modified into various shapes and a scope of the present invention should not be interpreted to be limited to the embodiments described hereafter.

These embodiments are provided to more fully explain the present invention to a person who has an average knowledge in the field of a technology where the present invention belongs to. Therefore, shapes of elements in the drawings may be shown with exaggeration to explain more clearly.

It should be noted that the same members among the drawings may have the same numerals.

Conventional elements and functions may be abbreviated if they are considered to make vague a point of the present invention unnecessarily.

Hereinafter, a dispenser 1 for supplying a toilet paper 3 of a roll type is described and drawn as a preferred exemplary embodiment of the present invention. However, the present invention is not limited the dispenser 1 but it may also be applied to various dispensers for supplying a disposable paper product of a roll type such as a hand towel and etc.

First Exemplary Embodiment

Figure 2:
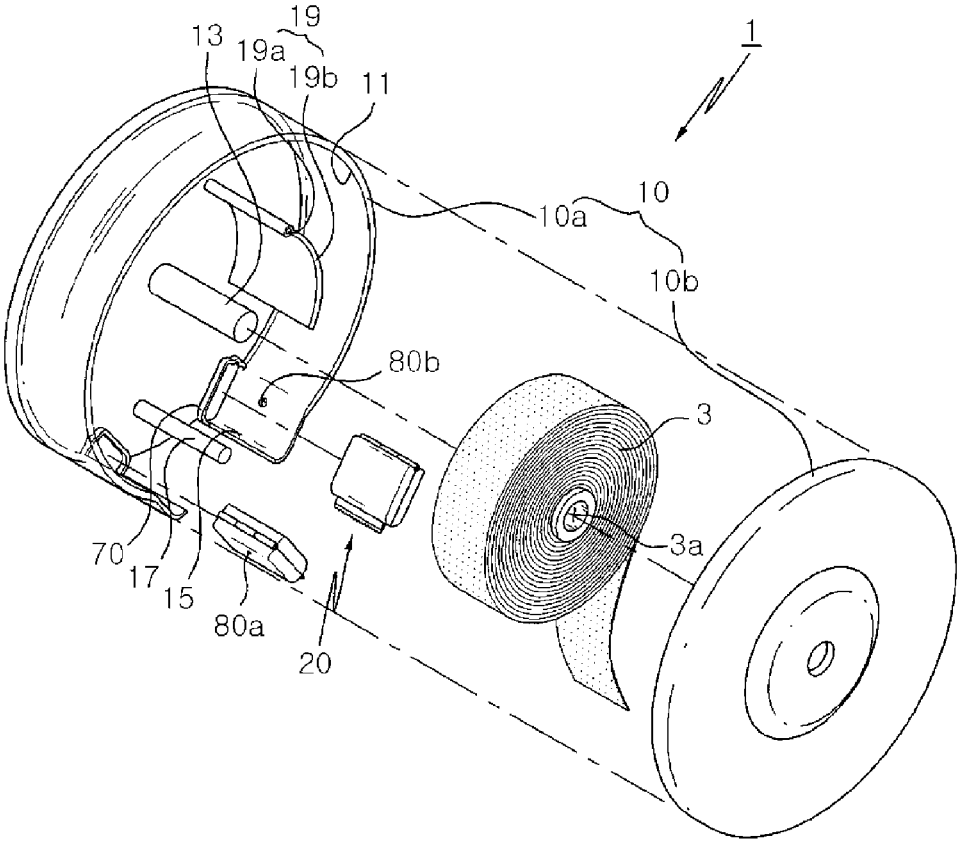
FIG. 2 is an exploded perspective view of a dispenser according to a first exemplary embodiment of the present invention.

FIG. 2 is an exploded perspective view of a dispenser 1 according to a first exemplary embodiment of the present invention.

As shown in FIG. 2, the dispenser 1 according to the first exemplary embodiment of the present invention comprises a main body casing 10 which accommodates a toilet paper 3 and a wet type cutting unit which supplies liquid to the toilet paper 3 discharged from a discharging part 15 of the main body casing 10.

The main body casing 10 has a rotating shaft 13 which supports the toilet paper 3 to be rotatable and the discharging part 15 through which the toilet paper 3 is discharged. The main body casing 10 accommodates the toilet paper 3 therein.

The main body casing 10 comprises a first main body casing 10*a* which has a front opening 11 and a second main body casing 10*b* which covers the front opening 11 of the first main body casing.

The rotating shaft 13 is located in the first main body casing 10*a* and the discharging part 15 is formed as an opening under the rotating shaft 13 at a lower end part of the first main body casing 10*a*.

A guide rod 17 is located at a center area of the discharging part 15 to be parallel with the rotating shaft 13.

The guide rod 17 may be injection-molded integrally with the main body casing 10 or may be installed to be rotatable in the main body casing 10.

The guide rod 17 guides the toilet paper 3 discharged through the discharging part 15 to the center area of the discharging part 15.

A tension maintaining part 19 may be located in the main body casing 10 to provide tension to the toilet paper 3 thus preventing the toilet paper 3 from being unwound freely.

The tension maintaining part 19 comprises a tension maintaining shaft 19*a* which is located at an inner and upper area of the main body casing 10 and extends to be parallel with the rotating shaft 13, and a tension maintain cover 19*b* which is rotatably coupled to the tension maintaining shaft 19*a* and has its cross section of an arc shape.

When a newly installed toilet paper 3 is inserted by the rotating shaft 13, the tension maintaining shaft 19*a* is located at an upper area apart from an outer circle of the toilet paper 3. It is preferable that a length of the tension maintaining shaft 19*a* is the same as or similar to a width of the toilet paper 3.

The tension maintaining cover 19*b* is formed to have an arc shape and is rotatable round the tension maintain shaft 19*a*. It is preferable that a curvature of the tension maintain cover 19*b* is the same as or similar to that of the outer circle of the newly installed toilet paper 3.

Also, it is preferable that the tension maintaining cover 19*b* is installed in a direction where the toilet paper 3 is unwound. Therefore, even if an outer diameter is getting smaller while the toilet paper 3 is being used, the tension maintaining cover 19*b* is rotated around the tension maintaining shaft 19*a* by gravity so that it can press the toilet paper 3.

Such a structure of the tension maintaining part 19 can be found in a conventional toilet paper holder.

Therefore, the structure of the tension maintaining part 19 can also be adopted from various structures of conventional holders for a roll type toilet paper.

A mounting part 70 where the wet type cutting unit 20 is mounted is formed at an inner surface of the first main body casing 10*a* to be near to the discharging part 15.

Figure 3:
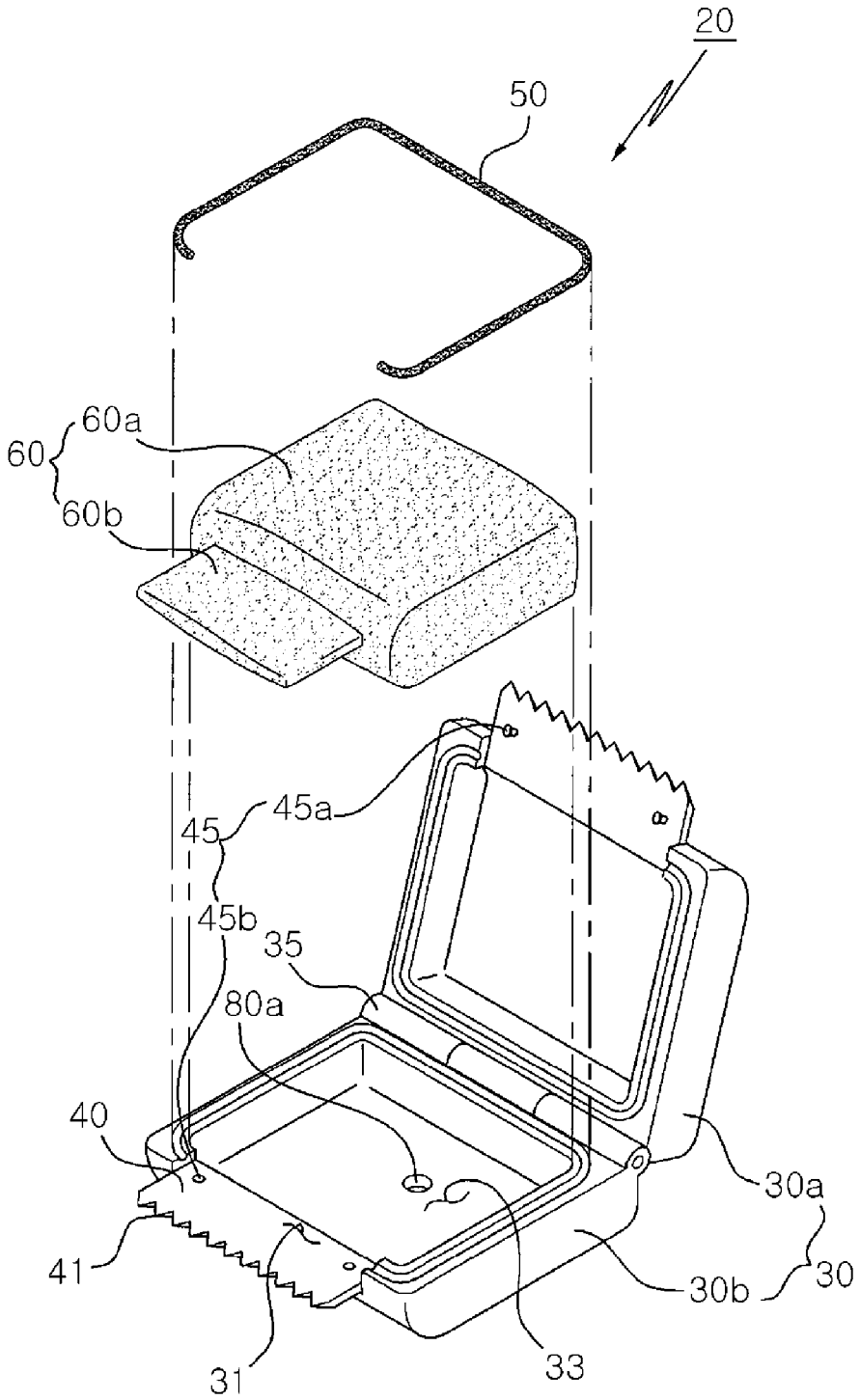
FIG. 3 is an exploded perspective view of a wet type cutting unit of the dispenser according to the first exemplary embodiment of the present invention.
Figure 5:
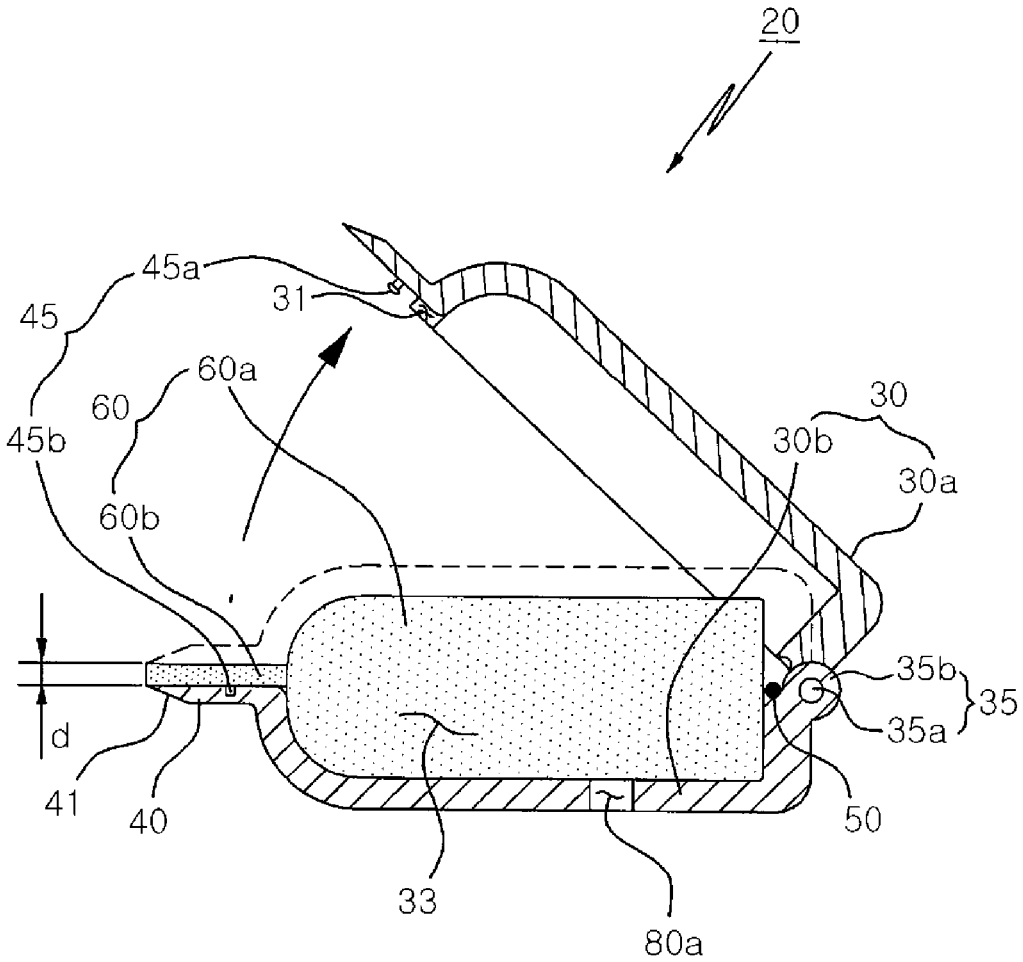
FIG. 5 is a sectional view of the wet type cutting unit of the dispenser according to the first exemplary embodiment of the present invention.

FIG. 3 is an exploded perspective view of the wet type cutting unit 20 of the dispenser 1 according to the first exemplary embodiment of the present invention. FIG. 5 is a sectional view of the wet type cutting unit 20 of the dispenser 1.

As shown in FIGS. 3 and 5, the wet type cutting unit 20 is provided to the discharging part 15 and supplies liquid to an area of the toilet paper 3 to be cut.

The wet type cutting unit 20 has a cutting casing 30 and a pair of guiding parts 40.

The cutting casing 30 has a liquid discharging part 31 at a side part thereof and a sponge receiving space 33 therein.

The cutting casing 30 may comprise a first cutting casing 30*a* and a second cutting casing 30*b* which are provided to be attached and detached there between to open or close the sponge receiving space 33.

Although the cutting casing 30 is formed as a box of a roughly rectangular shape in this exemplary embodiment, it is not limited regarding its shape as long as the sponge receiving space 33 is formed therein.

In this exemplary embodiment, as shown in FIG. 3, the first cutting casing 30*a* and the second cutting casing 30*b* are coupled together with a hinge.

That is, a hinge part 35 is provided between the first cutting casing 30*a* and the second cutting casing 30*b*. The hinge part 35 is located at the opposite side of the liquid discharging part 31.

In this exemplary embodiment, as shown in FIG. 5, the hinge part 35 comprises a hinge shaft 35*a* and a hinge shaft receiving part 35*b*.

The hinge shaft 35*a* may be provided as a rod or a screw.

Although the first cutting casing 30*a* and the second cutting casing 30*b* are described to be coupled therebetween with the hinge part 35, the present invention is lot limited to the description and the first and the second cutting casings 30*a*, 30*b* may also be coupled therebetween through inserting or fastening with hooks, rivets or screws.

The liquid discharging part 31 is formed as an opening at a side part of the cutting casing 30.

The liquid discharging part 31 is formed as an elongated hole in a direction along a width of the toilet paper 3. It is preferable that a length of the elongated hole is the same as or similar to the width of the toilet paper 3.

A pair of the guiding parts 40 extend from both sides of the liquid discharging part 31 with a predetermined gap d there between.

In this exemplary embodiment, the guiding parts 40 extend from the first cutting casing 30*a* and the second cutting casing 30*b* at the liquid discharging part 31 to be provided as plates parallel there between with the gap d.

A pair of the guiding parts 40 are locked or unlocked there between by a locking part 45.

In this exemplary embodiment, the locking part 45 comprises a locking protrusion 45*a* and a locking protrusion receiving part 45*b* which are coupled there between by the relative rotation of the first cutting casing 30*a* to the second cutting casing 30*b*.

It is preferable that the locking protrusion 45*a* and the locking protrusion receiving part 45*b* are coupled together in a forced inserting manner to maintain a coupling force there between.

The locking part 45 may be provided as fastening means such as screws, rivets, pins and etc.

The dispenser 1 according to this exemplary embodiment of the present invention may further comprise a sealing member 50 which seals a coupling area between the first cutting casing 30*a* and the second cutting casing 30*b*.

The sealing member 50 is provided as a shape of a line which is disposed along a border area of the first and the second cutting casings 30*a* and 30*b*.

The sealing member 50 is preferably made of a rubber. Also, the sealing member 50 is provided as an O-ring or a gasket.

As a second sponge 60*b* which is described later is disposed between a pair of the guiding parts 40, it is preferable that the sealing member 50 is formed as a shape of "⊏" to be installed along the border area of the first and the second cutting casings 30*a*, 30*b* excluding the liquid discharging part 31.

The wet type cutting unit 20 may further comprise a sponge unit 60 having a first sponge 60*a* which is received in the sponge receiving space 33 of the cutting casing 30 and a second sponge 60*b* which extends from the first sponge 60*a* to be received between a pair of the guiding parts 40.

As a volume of the first sponge 60*a* is bigger than that of the second sponge 60*b* as shown in the figures, the first sponge 60*a* holds the liquid relatively more than the second sponge 60*b* can hold.

The second sponge 60*b* protrudes from the first sponge 60*a* to be received between a pair of the guiding parts 40.

In a state of the wet type cutting unit 20 being installed in the main body casing 10, the second sponge 60*b* is located lower than the first sponge 60*a*.

In this case, the liquid in the first sponge 60*a* moves towards the second sponge 60*b* by gravity, so that the second sponge 60*b* can hold a relatively more liquid.

Therefore, the second sponge 60*b* can always hold the liquid as long as the sponge unit 60 is not dried out.

The second sponge 60*b* is provided to have the same length as or to be longer than the guiding part 40.

Figure 6:
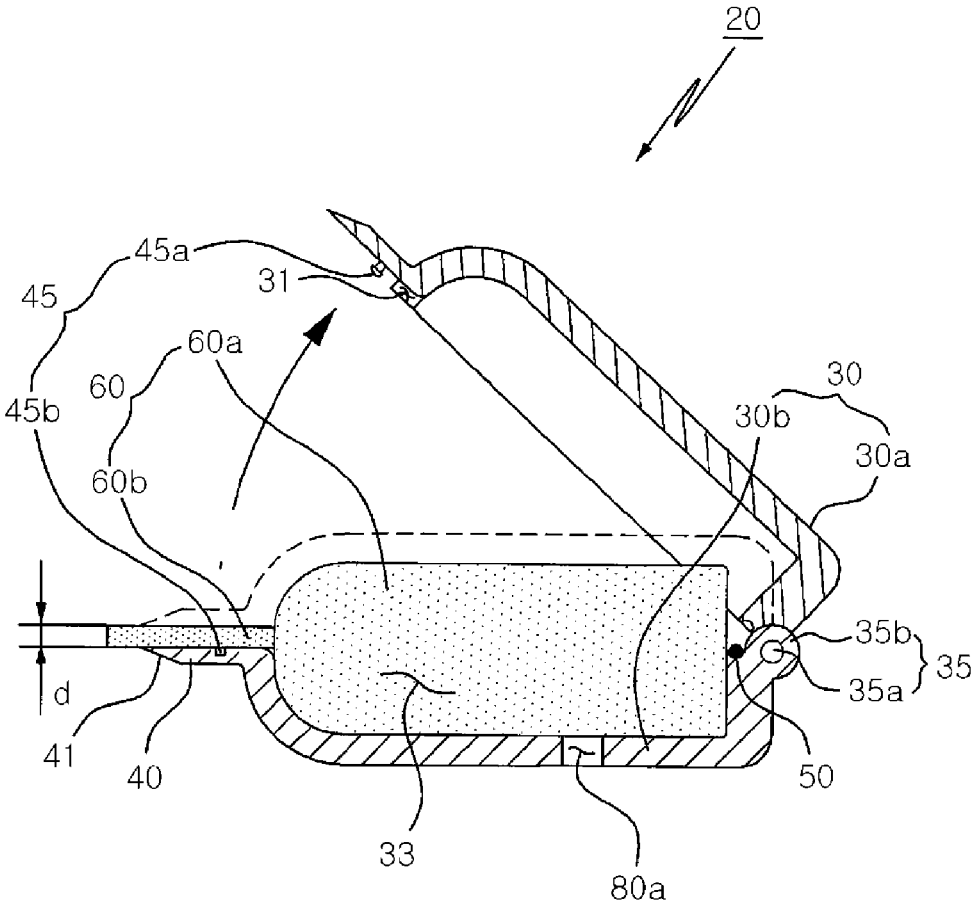
FIG. 6 is a sectional view of other exemplary embodiment of the wet type cutting unit of FIG. 5 where a length of a second sponge is changed.

As shown in FIGS. 5 and 6, the second sponge 60*b* protrudes from the first sponge 60*a* and extends to an end part of a blade 41 which is described later. Or, the second sponge 60*b* extends further to be exposed to an outside.

Therefore, the toilet paper 3 can directly contact the second sponge 60*b* to be supplied with the liquid.

In this exemplary embodiment, the sponge unit 60 may be a conventional sponge that is widely used or may be made of acetate tow.

In this exemplary embodiment, the liquid supplied to the sponge unit 60 may be a fragrant liquid such as aroma oil, perfume or etc as well as water.

In this case, a fragrance can be provided by the aroma oil held in the sponge unit 60 when there is no perfume or aromatic that needs to be additionally equipped.

At least one of the guiding parts 40 may have a free end area which is formed with a cutting edge 41 having a shape of a saw.

Although the cutting edge 41 is formed at both of the guiding parts 40 in this exemplary embodiment, it may also be formed at only one of the guiding parts 40.

Figure 4:
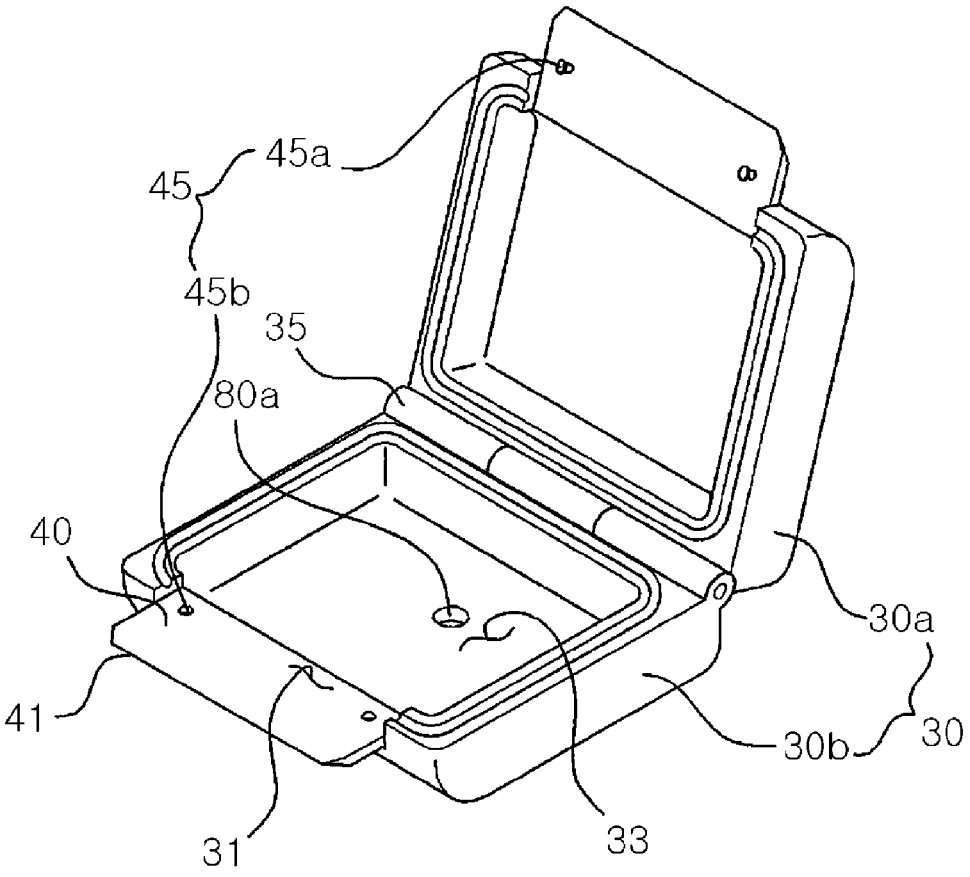
FIG. 4 shows other exemplary embodiment of a cutting casing of FIG. 3 where a shape of a cutting blade is changed.

The cutting edge 41 may have a shape of a saw as shown in FIG. 3 or a shape of a blade as shown in FIG. 4.

Such a cutting edge 41 may be made of the same material as the cutting casing 30 or injection-molded integrally.

Or, the cutting edge 41 may be made of a material different from that of the cutting casing 30 and inserted when injection-molding the cutting casing 30.

A first liquid inlet 80*a* may be formed at the cutting casing 30 to supply the liquid from outside.

In this case, it is preferable that a second liquid inlet 80*b* is formed at the main body casing 10 to correspond to the first liquid inlet 80*a*.

Therefore, if the sponge unit 60 is dried out, a user can supply the liquid to the sponge unit 60 through the first liquid inlet 80*a* and the second liquid inlet 80*b* by using an injecting device 5 such as a syringe.

Although, in this exemplary embodiment, the first and the second liquid inlets 80*a* and 80*b* are described and drawn as means for supplying the liquid into the cutting casing, the present invention is not limited to such means but may be have the cutting casing 30 provided with a cap or plug installed on a surface for opening an inside of the cutting casing 30.

In this case, the user can supply the liquid into the cutting casing 30 by operating the cap or the plug.

The wet type cutting unit 20 may be provided to be detachable from the main body casing 10.

As described above, the mounting part 70 is formed on an inner surface of the first main body casing 10*a* near the discharging part 15 for mounting the wet type cutting unit 20. The wet type cutting unit 20 is inserted into such a mounting part 70.

Therefore, as the wet type cutting unit 20 is coupled detachably to the main body casing 10, the user can separate the wet type cutting unit 20 from the main body casing 10 to charge the liquid.

Although, in this exemplary embodiment, the wet type cutting unit 20 is drawn to be inserted into the mounting part 70 in an axial direction of the rotating shaft 13, the mounting part 70 may also be provide such that the wet type cutting unit 20 is inserted in a rotational direction of the toilet paper 3.

Also, the wet type cutting unit 20 may be mounted to the main body casing 10 with a hook or through an adhering means such as a double-sided tape, Velcro and etc.

Although, in this exemplary embodiment, the wet type cutting unit 20 is provide at both sides of the discharging part 20, it may also be provided at only one side of the discharging part 15.

Although, in this exemplary embodiment, the dispenser 1 for supplying the toilet paper 1 is described, the present invention is not limited to this but may be applicable to various dispensers for supplying a disposable paper product of a roll type such as a hand towel and etc.

Hereinafter, an operating process of the dispenser 1 according to this exemplary embodiment of the present invention with reference to FIGS. 7 and 8.

Figure 7:
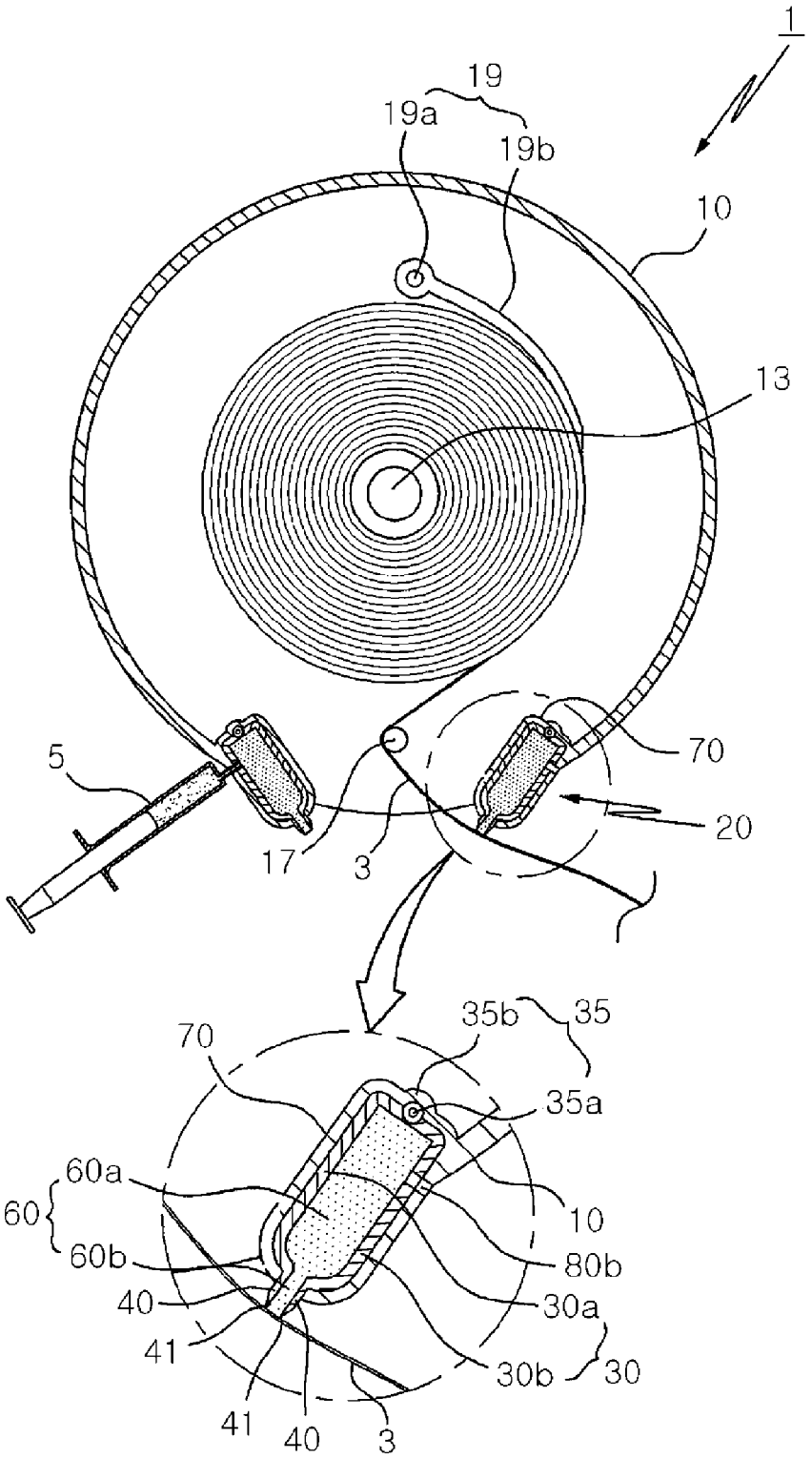
FIG. 7 and FIG. 8 are sectional views of the dispenser according to the first exemplary embodiment of the present invention to explain an operation of the dispenser.
Figure 8:
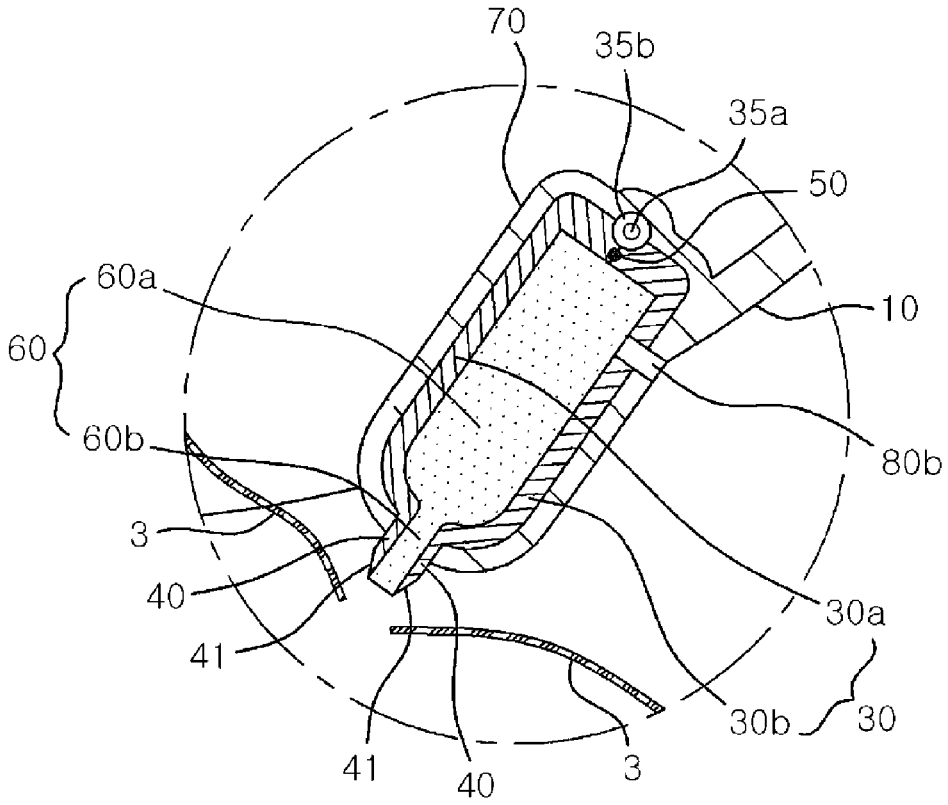

FIGS. 7 and 8 are sectional views showing the operating process of the dispenser 1 according to the first exemplary embodiment of the present invention.

Referring to FIG. 7, the liquid is charged enough in the sponge unit 60 and the toilet paper 3 is accommodated in the main body casing 10.

If the user softly pulls the toilet paper 3 which is exposed outside through the discharging part 15, the toilet paper 3 is unwound and drawn out while rotating around the rotating shaft 13.

If the user draws out the toilet paper 3 to a length he/she needs and pulls it toward the cutting casing 20, a part of a surface area of the toilet paper 3 contacts the second sponge 60*b* due to a force from the user.

Then, as shown in FIG. 8, the liquid held in the second sponge 60*b* which is located between a pair of the guiding parts 40 is provided from between a pair of the cutting edges 41 to the toilet paper 3.

As a result, the toilet paper 3 is easily cut at an area where it is provided with the liquid because a tensile strength is weakened at the area.

In addition, as the cutting edge 41 presses a vicinity of the area that is provided with the liquid, the user can cut the toilet paper 3 with a less force.

If the sponge unit 60 is dried out with a continual use, the user can supply the liquid to the sponge unit 60 through the first and second liquid inlets 80*a*, 80*b* by using the inserting device 5 such as a syringe and etc.

Also, as the wet type cutting unit 20 is detachably coupled to the main body casing 10 and the cutting casing 30 is provided to be dividable, the user can separate the wet type cutting unit 20 from the main body casing 10 and easily charge the liquid therein.

As described above, according to the present invention, a dispenser 1 can be provided which has a wet type cutting unit 20 provided for supplying liquid to an area of the toilet paper 3 to be cut, so that the toilet paper 3 can be easily cut with a relatively small force.

Second Exemplary Embodiment

Hereinafter, a dispenser according to a second exemplary embodiment of the present invention is described.

Figure 9:
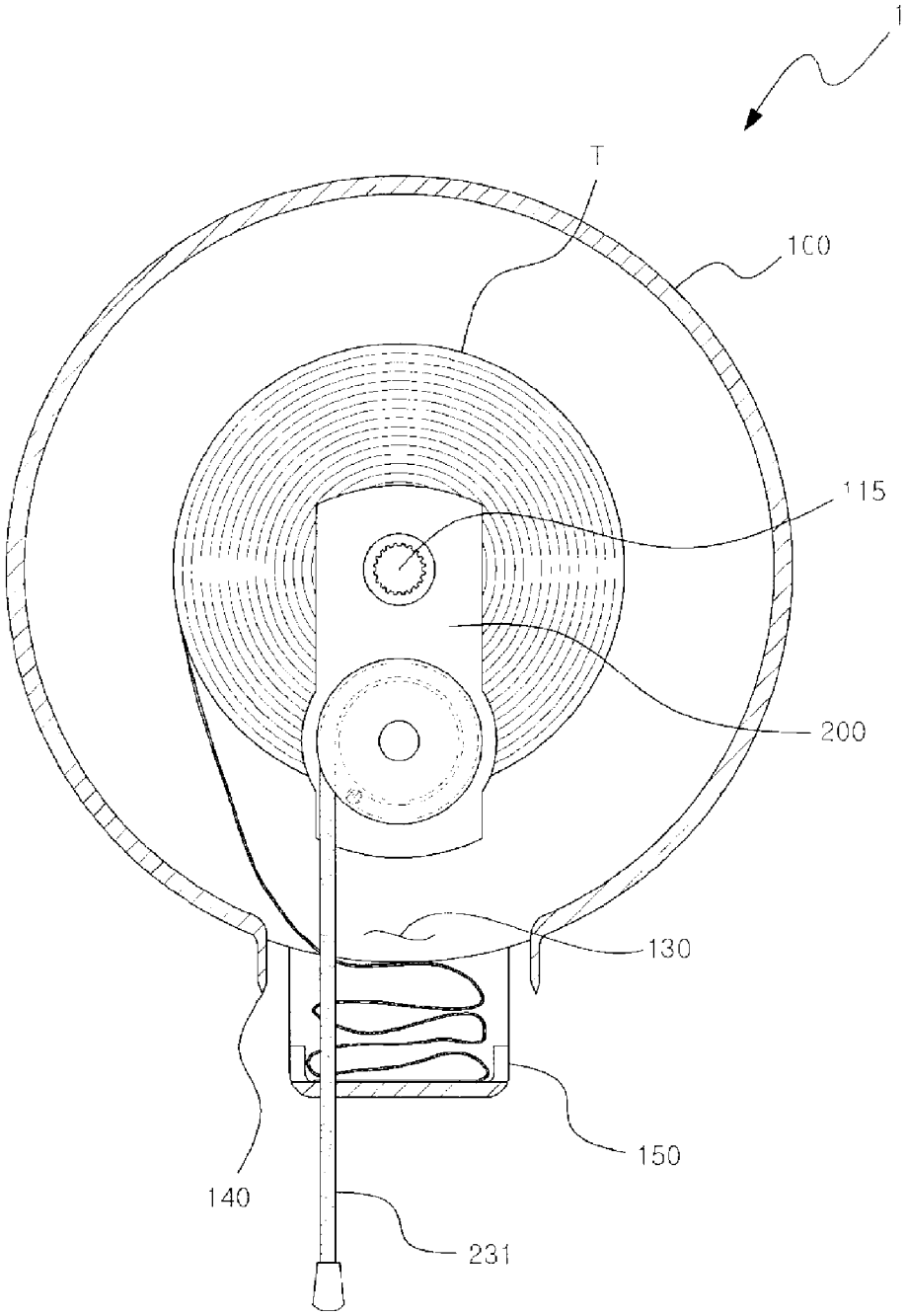
FIG. 9 is a front view of a dispenser according to a second exemplary embodiment of the present invention.
Figure 10:
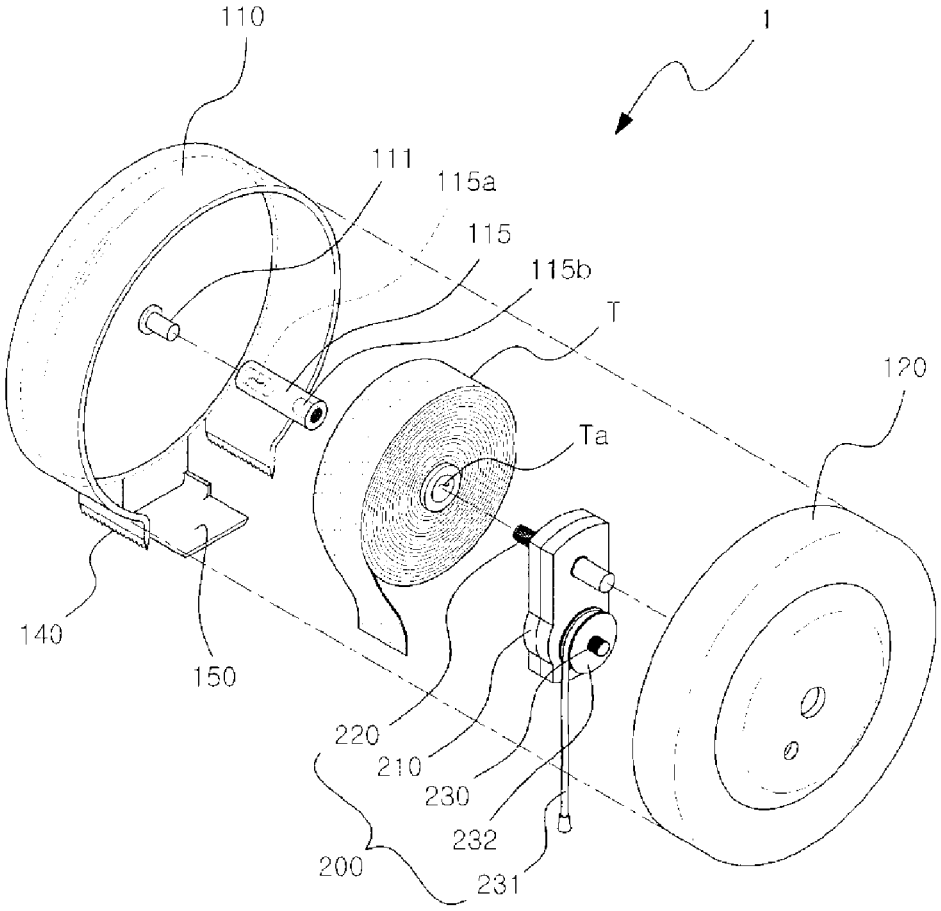
FIG. 10 is an exploded perspective view of the dispenser according to the second exemplary embodiment of the present invention.
Figure 11:
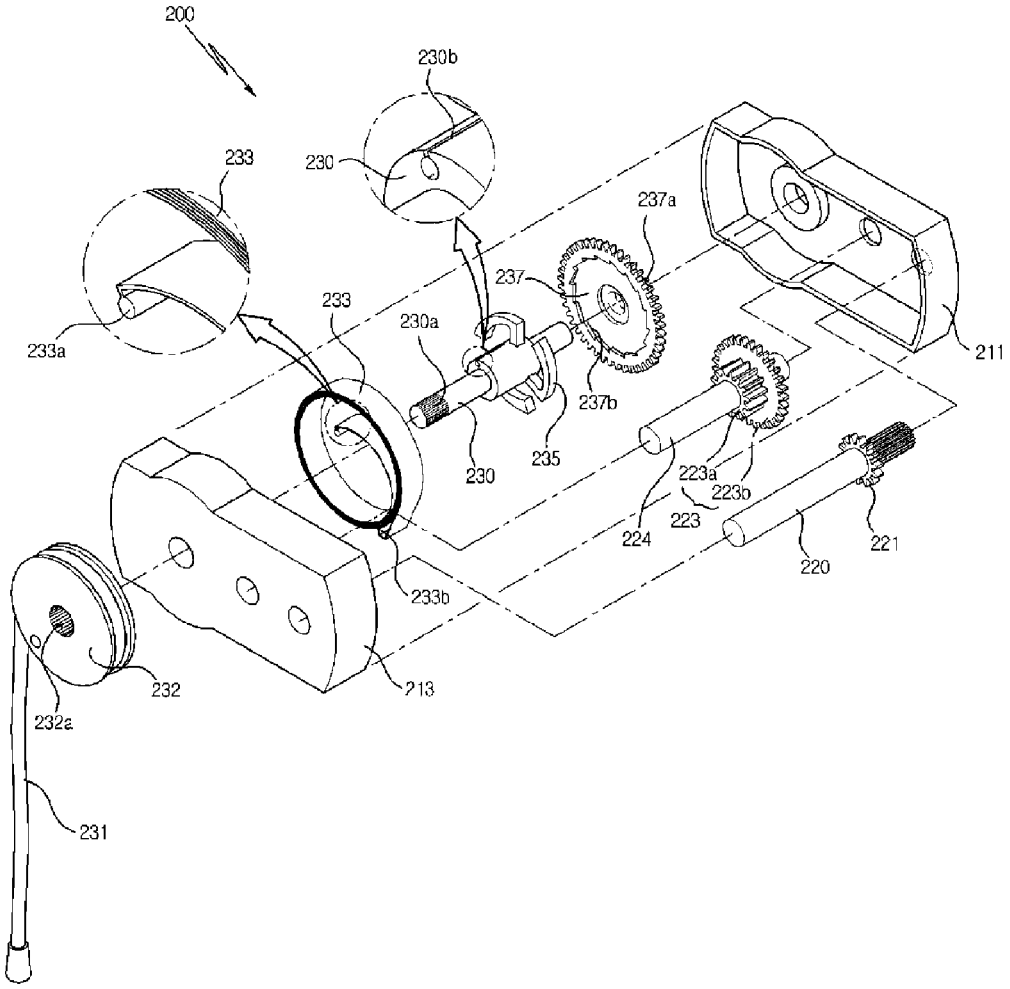
FIG. 11 is an exploded perspective view of an elastic discharging unit of the dispenser according to the second exemplary embodiment of the present invention.

FIG. 9 is a front view of the dispenser 1 according to the second exemplary embodiment of the present invention, FIG. 10 is an exploded perspective view of the dispenser 1 according to the second exemplary embodiment of the present invention, and FIG. 11 is an exploded perspective view of an elastic discharging unit 200 of FIG. 10.

As shown in the figures, the dispenser 1 comprises a main body casing 100 which accommodates a paper product T and the elastic discharging unit 200 which is installed in the main body casing 100 and enables the paper product T to be supplied automatically when a wire 231 is pulled.

As shown in FIG. 10, the main body casing 100 comprises a first casing 110 and a second casing 120.

The first casing 110 has a shape of a case with a front opening and accommodates the paper product T therein.

The second casing 120 is coupled to the first casing 110 to cover the front opening of the first casing 110. The elastic discharging unit 200 is coupled to the second casing 120.

The first casing 110 has a supporting rib 111 which supports a rotating shaft 115 to be rotatable and the rotating shaft 115 which is supported by the supporting rib 111 at one end and is coupled to a driving shaft 220 of the elastic discharging unit 200 at the other end. The rotating shaft 115 is inserted in a shaft hole Ta of the paper product T.

A discharging part 130 where the paper product T is discharged is formed at a lower end part of the first casing 110. A cutting edge 140 is formed at both sides of the discharging part 130. A product receiving part 150 is provided to receive therein the paper product T discharged through the discharging part 130.

The supporting rib 111 protrudes from an inner surface of the first casing 110 to rotatably support the rotating shaft 115.

The supporting rib 111 is inserted into a rib receiving hole 115*a* of the rotating shaft 115.

The rotating shaft 115 is coupled to the driving shaft 220 and is rotated in the first casing 110 according to a rotation of the driving shaft 220.

The rotating shaft is inserted in the shaft hole Ta of the paper product T and rotates the paper product T to be supplied to the discharging part 130.

The rotating shaft 115 has at one end a rib receiving hole 115 to receive the supporting rib 111 and at the other end a driving shaft receiving hole 115*b* to be coupled to the driving shaft 220.

The cutting edge 140 is provided at both sides of the discharging part 130 to enable a user to cut the paper product T discharged through the discharging part 130.

The product receiving part 150 is located at a lower side of the discharging part 130 and is provided to surround the discharging part 130 in part.

The product receiving part 150 covers a lower area of the discharging part 130 to receive therein the paper product T which is automatically supplied with a predetermined length by the wire 231.

The product receiving part 150 may be integrally provided with the first casing 110 or may be detachably attached to the first casing 110.

The second casing 120 covers and closes the front opening of the first casing 110. The elastic discharging unit 200 is coupled to the second casing 120.

The second casing 120 has a wire withdrawing hole 121 to withdraw the wire 231 of the elastic discharging unit 200 to an outside. The wire 231 is exposed to a predetermined length downward from the wire withdrawing hole 121 to enable the user to pull.

As shown in FIGS. 10 and 11, the elastic discharging unit 200 is coupled to the second casing 120 and enables the rotating shaft 115 to rotate thus supplying the paper product T through the discharging part 130 to a predetermined length the user needs as much as he/she pulls the wire 231.

The elastic discharging unit 200 comprises a casing 210 received in the second casing 120, the driving shaft 220 disposed in the casing 210 and coupled to the rotating shaft 115, an elastic member driving shaft 230 disposed apart from the driving shaft 220 to a predetermined distance and coupled to an elastic member 233, the elastic member 233 and a wire 231 both coupled to the elastic member driving shaft 230, and a gear train 221, 223, 237 and a clutch gear 235 for transferring a rotation of the elastic member driving shaft 230 to the driving shaft 220.

The casing 210 comprises a front casing 211 and a rear casing 213 coupled therebetween.

The driving shaft 220 is coupled to the front casing 211 and the rear casing 213 to be rotatable and is fixedly coupled to the rotating shaft 115 through the front casing 211.

A second transfer gear 221 is coupled to the driving shaft 220 to transfer a rotation force from the elastic member driving shaft 230 to the driving shaft 220.

The elastic member driving shaft 230 is located apart from the driving shaft 220 to a predetermined distance and has a part where the elastic member 233 wound and another part where the wire 231 is wound.

The elastic member driving shaft 230 is rotatably coupled to the front casing 211 and the rear casing 213. The elastic member 233 is coupled to the elastic member driving shaft 230.

In detail, an inner end part 233*a* of the elastic member 233 is inserted into an elastic member coupling hole 230*b*.

An outer end part 233*b* of the elastic member 233 is fixed to the rear casing 213. The elastic member 233 is provided as a windup spring that is wound to several turns around the elastic member driving shaft 230.

The wire 231 is wound around an end part of the elastic member driving shaft 230 which is exposed at an outside of the rear casing 213.

A wire supporting plate 232 is coupled to an end part of the elastic member driving shaft 230.

The wire supporting plate 232 has an outer circumference of a 'U' shape to hold and support the wire 231 around the elastic member driving shaft 230.

Teeth 230*a* are formed on a round surface of the elastic member driving shaft 230 in an axial direction and coupled to grooves 232*a* formed on an inner surface of a shaft hole of the wire supporting plate 232.

Accordingly, if the user pulls the wire 231 downwards, the elastic member driving shaft 230 is rotated integrally with the wire supporting plate 232.

A clutch gear 235 is provided to the elastic member driving shaft 230. The clutch gear 235 is a shaft connecting means for connecting or disconnecting a driving force between shafts.

In this exemplary embodiment, the clutch gear 235 enables the rotating force to be transferred to the driving shaft 220 when the elastic member driving shaft 230 is rotated in a direction where the user pulls the wire 231 downward.

However, when the elastic member driving shaft 230 is rotated in a direction where the wire 231 moves upward, the clutch gear 235 prevents the rotating force from being transferred to the driving shaft 220.

The clutch gear 235 is engaged to an inner gear 237*b* of a first gear 237 to perform transferring the rotating force in one direction.

The first gear 237 is rotatably supported by the elastic member driving shaft 230 to transfer the rotating force from the elastic member driving shaft 230 to a second gear 221.

The first gear 237 has an outer gear 237*a* formed on an outer circumference and the inner gear 237*b* formed in an inner side of the outer gear 237*a*.

The outer gear 237*a* is engaged to a smaller gear 223*a* of a third gear 223 to transfer the rotating force according to a rotation of the elastic member driving shaft 230.

The inner gear 237*b* is engaged to the clutch gear 235 and transfers the rotating force to the second gear 221 only when the elastic member driving shaft 230 is rotated in a direction where the wire 231 is lowered.

The third gear 223 is provided between the first gear 237 and the second gear 221 to transfer the rotating force from the elastic member driving shaft 230 to the driving shaft 220.

The third gear 223 is coupled to a third gear supporting shaft 224 which is rotatably supported by the front casing 211 and the rear casing 213.

The third gear 223 comprises the smaller gear 223*a* and a bigger gear 223*b* which have the same axis of rotation.

The smaller gear 223*a* is engaged to the first gear 237 and the bigger gear 223*b* is engaged to the second gear 221.

Figure 12:
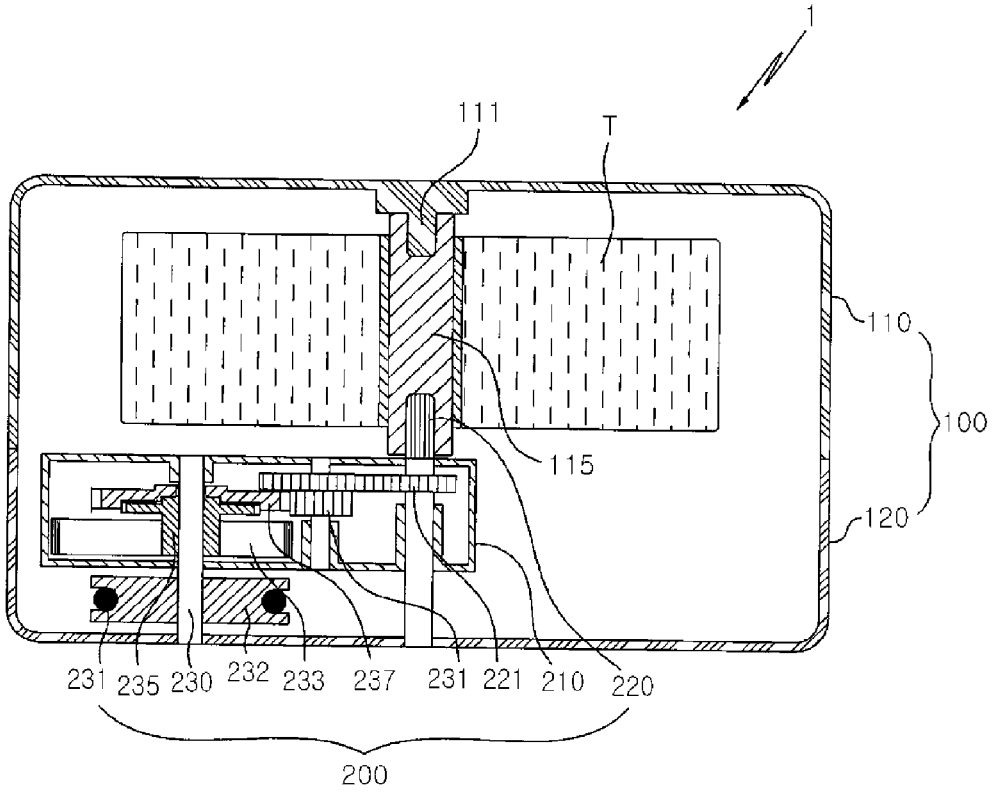
FIG. 12 is a sectional view of the dispenser according to the second exemplary embodiment of the present invention.
Figure 13:
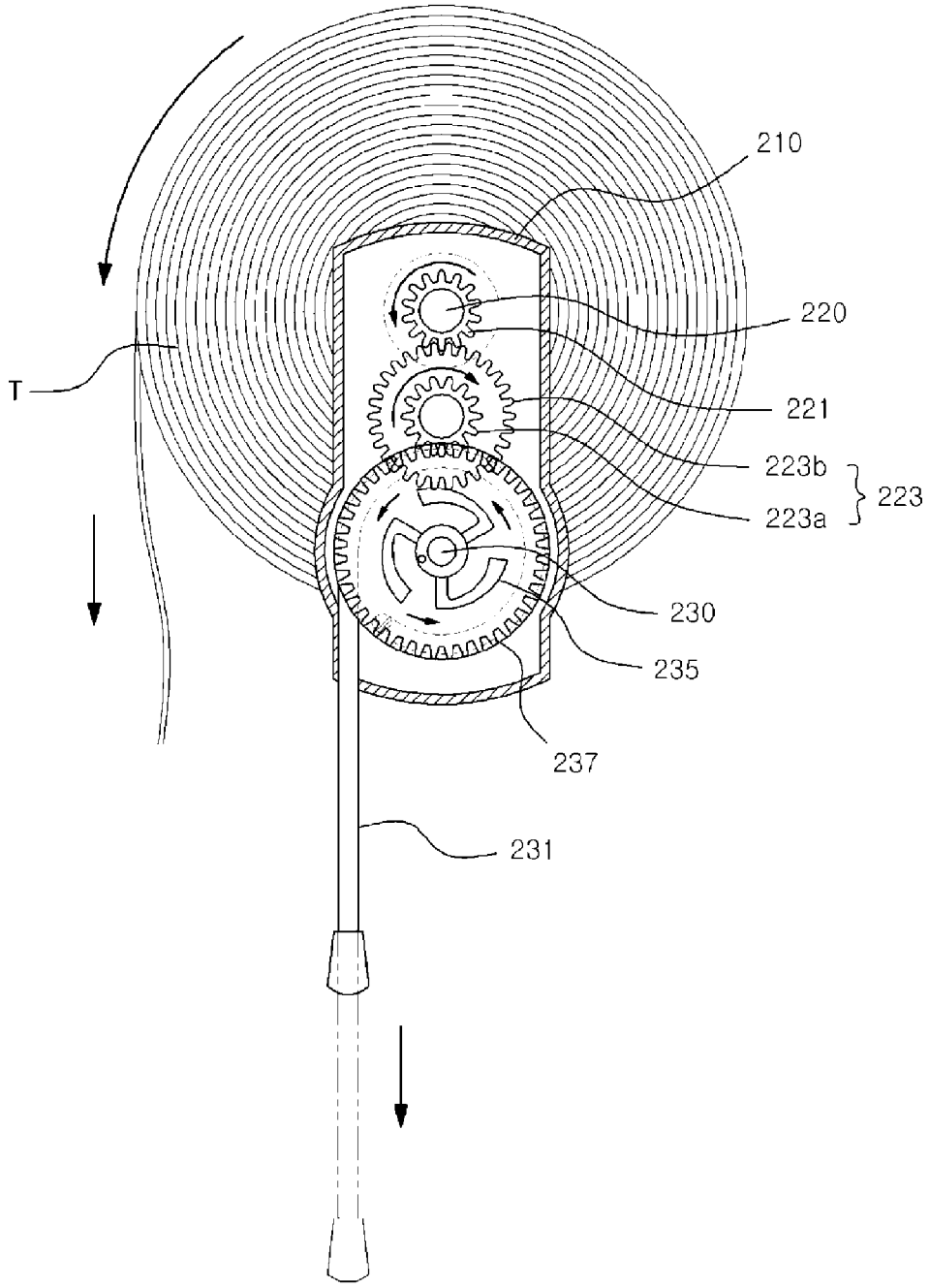
FIG. 13 is a schematic sectional view for showing an operation of the dispenser according to the second exemplary embodiment of the present invention.

Referring to FIGS. 12 and 13, a process where the paper product T is supplied by the dispenser 1 with such a constitution as described above is described hereinafter.

The user who needs the paper product T pulls down the wire 231 which is exposed under the main body casing 100.

If the wire 231 is pulled, the elastic member driving shaft 230 is rotated in a direction in which the wire 231 is unwound.

If the elastic member driving shaft 230 is rotated in the direction where the wire 231 is unwound, the elastic member 233 which has been fixed to the elastic member driving shaft 230 is rotated in a direction in which it is wound around the elastic member driving shaft 230 further than it is in an initial state.

At the same time, the clutch gear 235 which is fixed to the elastic member driving shaft 230 is rotated together thus rotating the first gear 237.

According to the rotation of the first gear 237, the smaller gear 223*a* and the bigger gear 223*b* of the third gear 223 are rotated together.

If the second gear 221 which is engaged to the bigger gear 223*b* is rotated, the driving shaft 220 is rotated.

According to the rotation of the driving shaft 220, the rotating shaft 115 to which the paper product T is coupled is rotated.

Due to the rotation of the rotating shaft 115, the paper product T is unwound and discharged through the discharging part 130. The discharged paper product T is received into the product receiving part 150.

The user pulls the wire 231 several times to the length of the paper product T he/she needs. If the paper product T is received in the product receiving part 150 to the length he/she needs, it is pressed against the cutting edge 140 and cut to be used.

If the user releases the wire 231, the elastic member 23 is unwound elastically to return to its initial state while the wire 231 is raised up.

Accordingly, the elastic member driving shaft 230 and the clutch gear 235 which is integrally coupled to the elastic member driving shaft 230 are rotated together. However, the first gear 237 which is coupled to the clutch gear 235 in one direction is not rotated.

As described above, according to the dispenser of the present invention, if the user pulls the paper product T to a length he/she needs, the rotating shaft is rotated by the elastic force of the elastic member to discharge the paper product T through the discharging part, so that the user's convenience can be enhanced.

Figure 14:
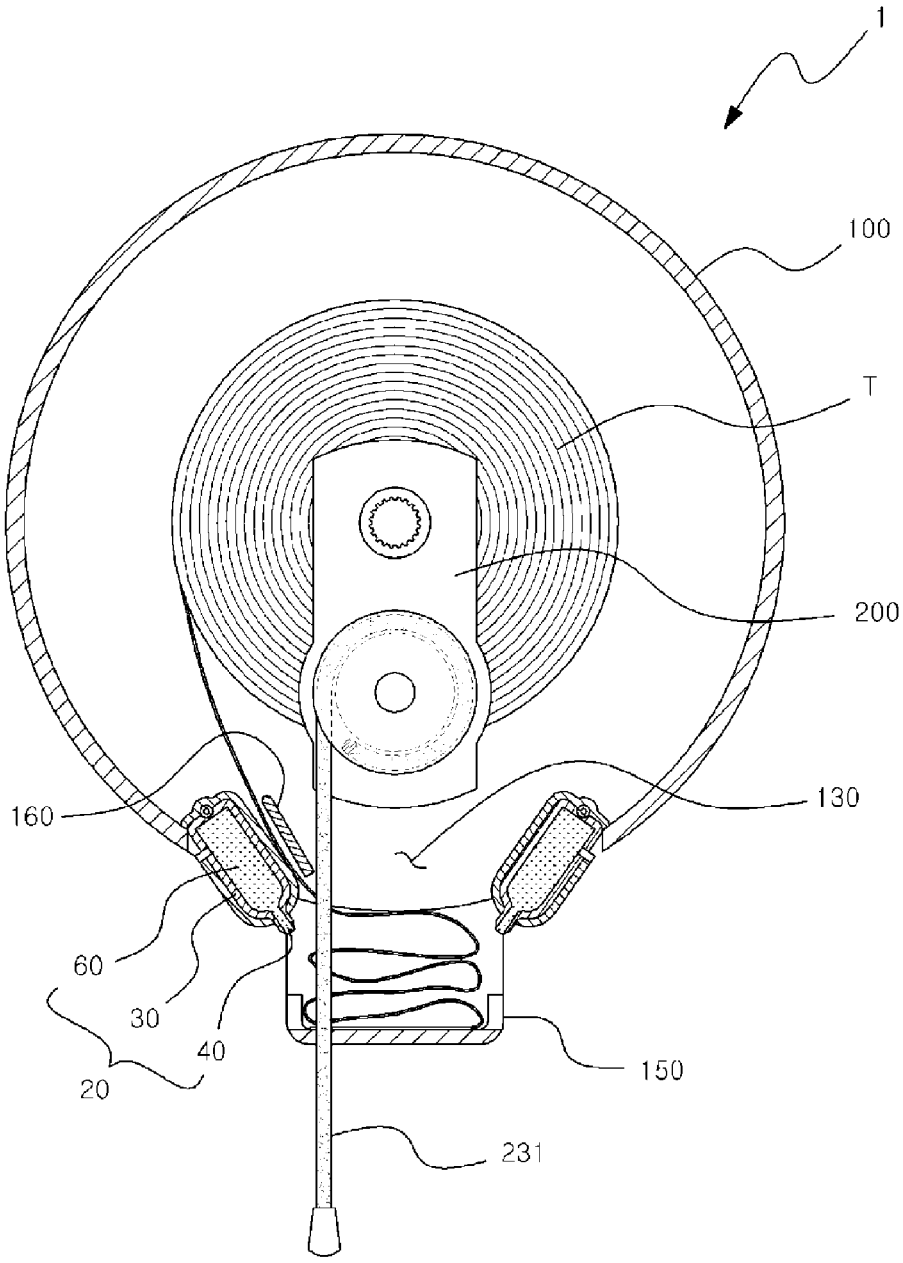
FIG. 14 is a front view of a modification of the dispenser according to the second exemplary embodiment of the present invention.

FIG. 14 is a front view of a modification of the dispenser according to the second exemplary embodiment of the present invention.

The dispenser 1 includes at its discharging part 130 a wet type cutting unit 20 which supplies liquid to an area of the paper product T to cut.

The wet type cutting unit 20 comprises a sponge 60, a cutting casing 30, a cutting guide 40 and etc. which are the same as those in the exemplary embodiment of the present invention and whose detailed descriptions are omitted here.

According to the dispenser 1, if the paper product is automatically supplied to a predetermined length by the wire and received in the product receiving part 150, the user contacts the area to cut in the paper product onto the cutting guide 40 of the wet type cutting unit 20.

Therefore, the paper product T which has contacted the cutting guide 40 is cut instantaneously.

Also, in this modification, a discharging guide 160 is located in the main body casing 100 at an inner side of the discharging part 130.

The discharging guide 160 guides the paper product T which is supplied by the rotation of the driving shaft 220 as described above to be easily discharged through the discharging part 130.

Also, the discharging guide 160 prevents the paper product T from being not unrolled due to an excessive rotation speed of the driving shaft 220.

Figure 15:
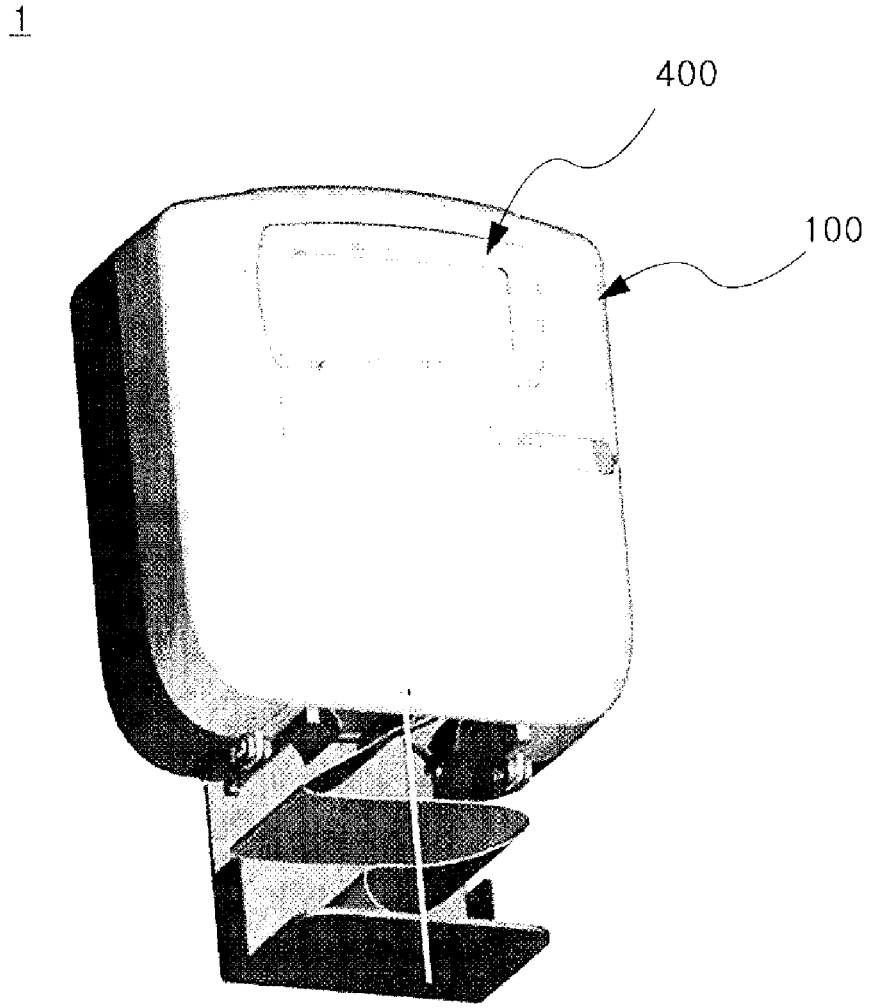
FIG. 15 is a perspective view of another modification of the dispenser according to the second exemplary embodiment of the present invention.

FIG. 15 is a perspective view of another modification of the dispenser according to the second exemplary embodiment of the present invention, where a display unit 400 is provided in the dispenser 1.

In this modification, the display unit 400 is mounted on a front surface of the main body casing 100 to make the user recognize an advertisement phrase or design thus improving an advertising effect.

Figure 16:
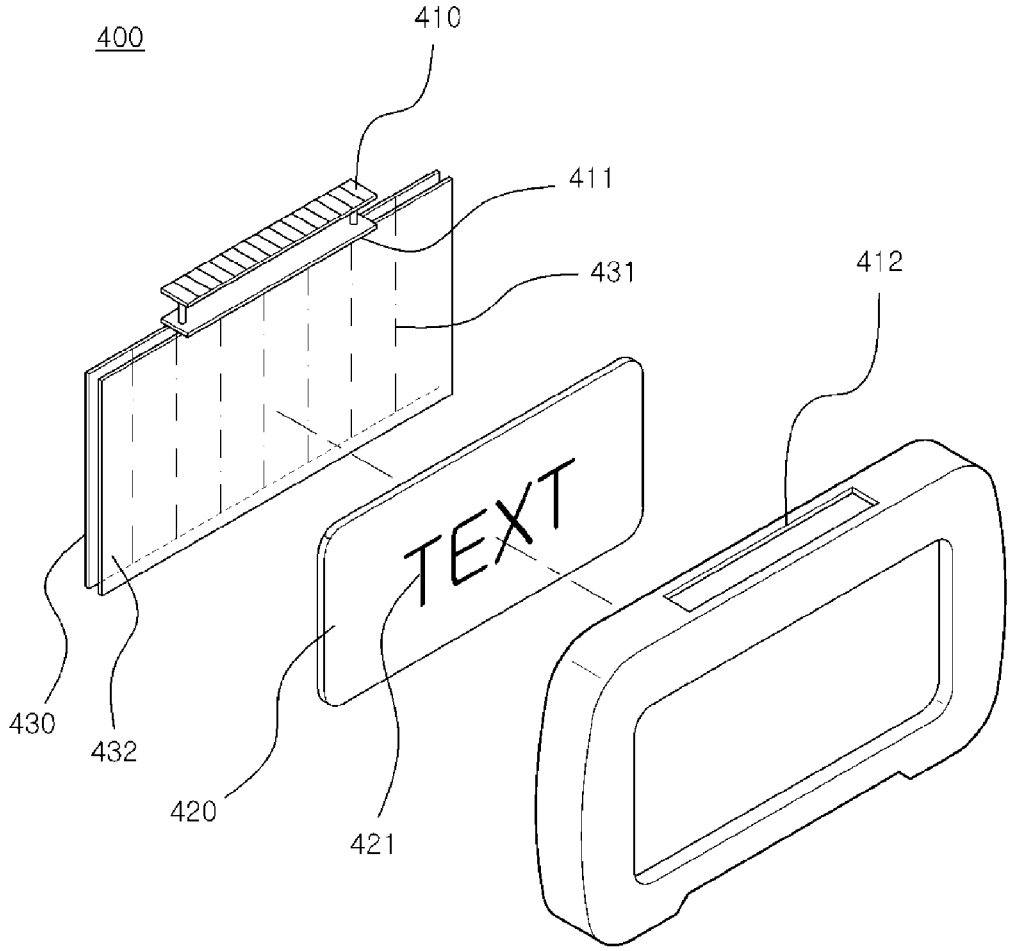
FIG. 16 is an exploded perspective view of a display unit of the dispenser of FIG. 15.

FIG. 16 is an exploded perspective view of the display unit 400 of the dispenser 1 of FIG. 15.

The display unit 400 comprises a display panel 420 which displays letters, pictures or advertisements and liquid crystal panel 430 which is attached to the display panel 420 to pass or reflect light and a power supplying part 410 which supplies an electric power to the liquid crystal panel 430.

In this embodiment, the power supplying part 410 is a solar battery.

The liquid crystal panel 430 is divided into a plurality of sectors 431 in front of the display panel 420 and a polarization film is attached to the liquid crystal panel 430 to protect the liquid crystal panel 430 and to polarize light.

Also, a solar battery mounting part 412 is provided on an upper side of the display unit 400. The solar battery 410 which is mounted in the solar battery mounting part 412 supplies electric power to the liquid crystal panel 430.

The solar battery 410 is a device which converts light energy emitted from a natural light or an illuminating device into an electric energy, so that it supplies the electric power for driving the liquid crystal panel 430.

The electric energy generated by the solar battery 410 is controlled by a control chip on a board 411 which is connected to the liquid crystal panel 430.

Therefore, the liquid crystal panel 430 turns on and off sequentially among the sectors 431 to make the user clearly recognize a mark 421.

Also, it is semi-permanent and environmentally friendly because the liquid crystal panel 430 and the display panel 420 are driven only by the solar battery 410.

Of course, there is no use of changing batteries because the solar battery 410 is used.

Figure 17:
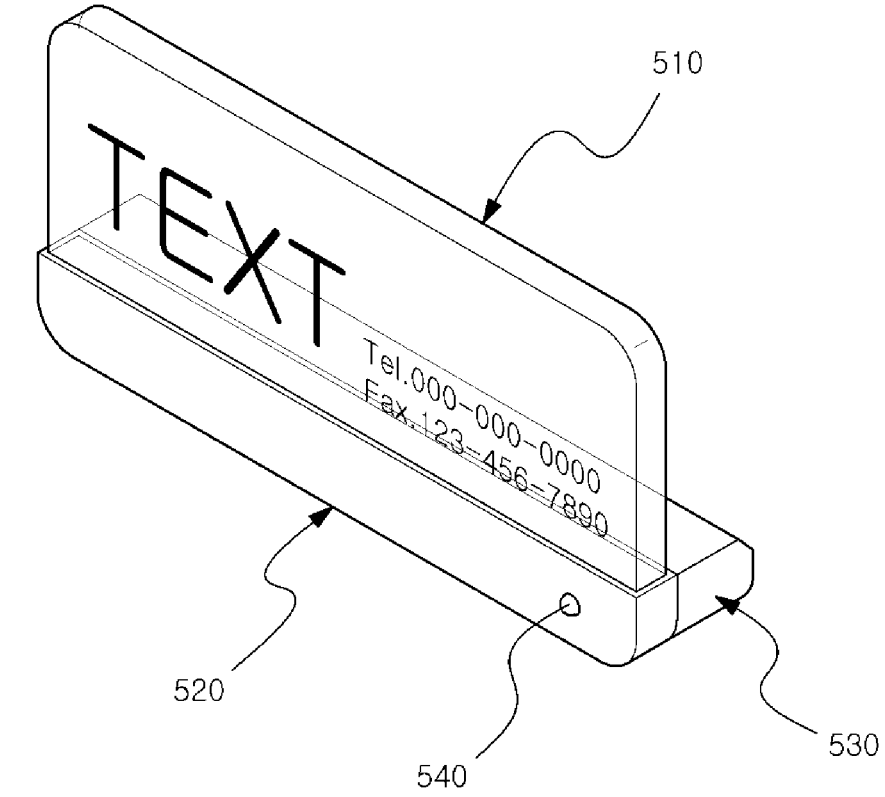
FIG. 17 is a perspective view of a memo board adopted in another modification of the dispenser according to the second exemplary embodiment of the present invention.

On the other hand, the display unit 400 described above may be substituted by a memo board 500 shown in FIG. 17.

The memo board 500 is provided to display an advertising phrase or design thereon.

Figure 18:
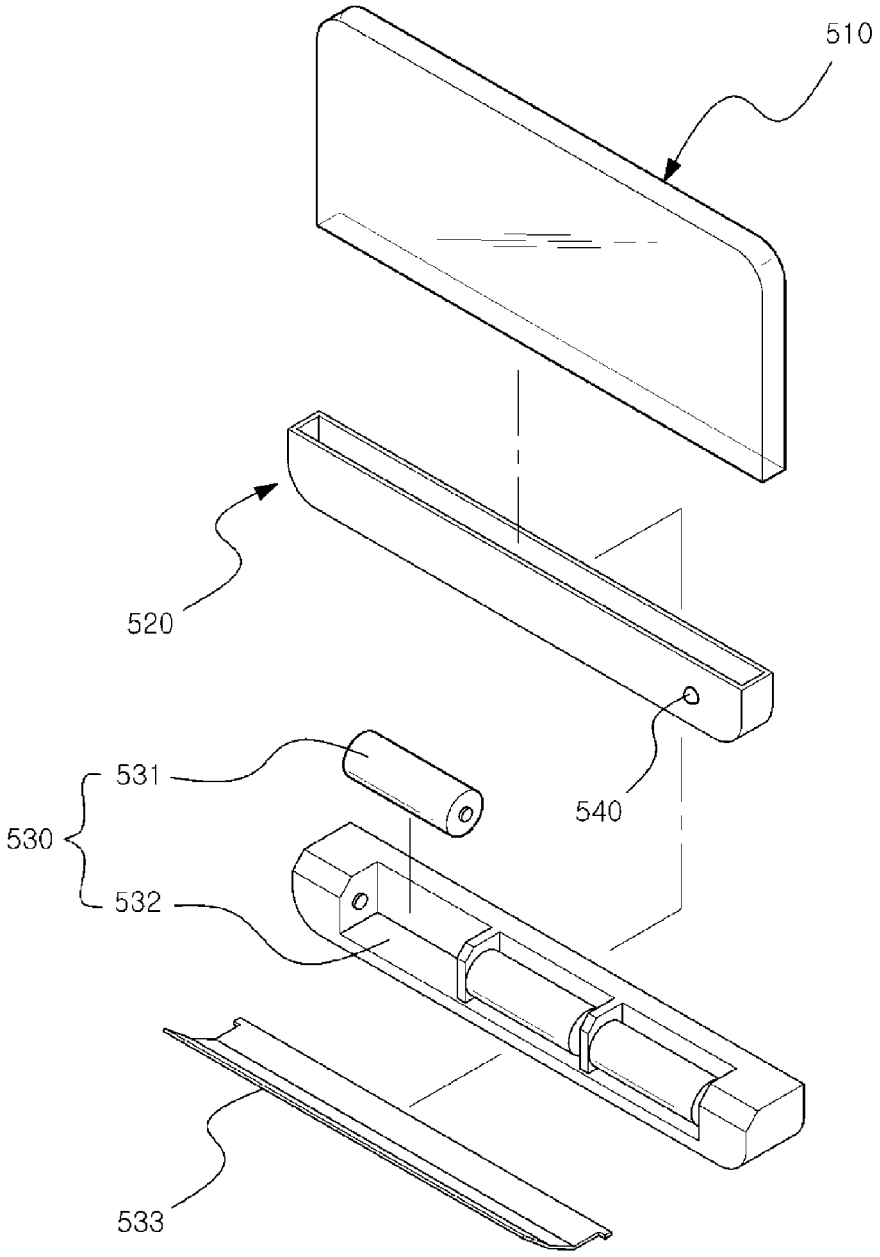
FIG. 18 is an exploded perspective view of the memo board of FIG. 17.

To be more specific, as shown in FIG. 18, the memo board 500 to be mounted to the main body casing 100 comprises a transparent memo plate 510 which displays the advertising phrase or design thereon, an illuminating part 520 which is fixed to an end part of the transparent memo plate 510 to emit light through the transparent memo plate 510, a power supplying part 530 for supplying an electric power to the illuminating part 520 and a power supplying switch 540 for controlling an electric current applied from the power supplying part 530.

The transparent memo plate 510 is made of transparent plastics such as acryl resin or glass having a predetermined thickness.

The illuminating part 520 is fixed to a lower end part of the transparent memo plate 510 and has an LED (light emitting diode) therein to illuminate the transparent memo plate 510 at its upper side when it is turned on by the power supplying switch 540.

The power supplying part 230 is provided at a rear side of the illuminating part 520 and has therein a plurality of batteries 531 as a power source of the LED.

Also, at the rear side of the illuminating part 520 may be provided a receiving part 532 to receive the batteries 531 and a cover 533 to cover the receiving part 532.

Accordingly, the memo board 500 may always be in an 'ON' state for a convenience in use to enable the advertising phrase or design to be easily recognized even in the dark.

Although the exemplary embodiment of the present invention has been disclosed, various modifications, additions and substitutions are possible, without departing from the scope and spirit of the invention. Therefore, the above embodiment must be regarded as one example provided for description of the present invention, rather than to limit the present invention.

The invention claimed is:

1. A dispenser for supplying a disposable paper product of a roll type comprising:

a main body casing which accommodates the paper product and has a rotating shaft supporting the paper product to be rotatable and a discharging part for discharging the paper product;

an elastic discharging unit which has a wire rolled at a side of the main body casing and supplies the paper product by rotating the rotating shaft elastically when the wire is pulled by an outer force, said discharging unit further comprising a driving shaft connected with the rotating shaft, an elastic member driving shaft provided apart from the driving shaft, the wire rolled at an end part of the elastic member driving shaft and pulled downward by the outer force, a windup spring wound around the elastic member driving shaft and driving the elastic member driving shaft to rotate if the wire is pulled downward so that the wire can return upward, and a gear train comprising a first gear coupled to the elastic member driving shaft, a second gear coupled to the driving shaft and a third gear provided between the first gear and the second gear to transfer the rotation force transferring a rotation force due to the windup spring from the elastic member driving shaft to the driving shaft and further comprises a clutch gear which transfers the rotation force from the elastic member driving shaft to the driving shaft only while the wire is being pulled downward; and a wet type cutting unit which is located at the discharging part to provide liquid to a part of the paper product that is to be cut.

2. The dispenser according to one of claim 1, wherein the main body casing further comprises a product receiving part which is provided near the discharging part to receive the paper product that is supplied due to a rotation of the driving shaft.

3. A dispenser for supplying a disposable paper product of a roll type comprising:

a main body casing which accommodates the paper product and has a rotating shaft supporting the paper product to be rotatable and a discharging part for discharging the paper product;

an elastic discharging unit which has a wire rolled at a side of the main body casing and supplies the paper product by rotating the rotating shaft elastically when the wire is pulled by an outer force;

a driving shaft connected with the rotating shaft;

an elastic member driving shaft provided apart from the driving shaft, the wire rolled at an end part of the elastic member driving shaft and pulled downward by the outer force;

a windup spring wound around the elastic member driving shaft and driving the elastic member driving shaft to rotate if the wire is pulled downward so that the wire can return upward;

a gear train having a first gear coupled to the elastic member driving shaft;

a second gear coupled to the driving shaft;

a third gear provided between the first gear and the second gear for transferring a rotation force due to the windup spring from the elastic member driving shaft to the driving shaft, wherein the gear train further comprises a clutch gear which transfers the rotation force from the elastic member driving shaft to the driving shaft only while the wire is being pulled downward;

a wet type cutting unit which is located at the discharging part to provide liquid to a part of the paper product that is to be cut; and a display unit comprising a display panel which is mounted to the main body casing to display letters, pictures or advertisements, a liquid crystal panel which is attached to the display panel to pass or reflect light, a polarization film which is attached to the liquid crystal panel and a power supplying part which supplies an electric power to the liquid crystal panel.

4. The dispenser according to claim 3, wherein the main body casing further comprises a product receiving part which is provided near the discharging part to receive the paper product that is supplied due to a rotation of the driving shaft.

* * * * *